United States Patent [19]

Pessel et al.

[11] 4,040,230

[45] Aug. 9, 1977

[54] METHOD FOR FILLING CONTAINERS WITH COMPRESSED BLOCKS OF GARBAGE

[75] Inventors: Kurt Pessel; Eberhard Stodt, both of Dusseldorf, Germany

[73] Assignee: Lindemann Maschinenfabrik GmbH, Dusseldorf, Germany

[21] Appl. No.: 682,160

[22] Filed: Apr. 30, 1976

[30] Foreign Application Priority Data

May 9, 1975 Germany ..... 2520573

[51] Int. Cl.[2] ..... B65B 63/02; B65B 1/32

[52] U.S. Cl. ..... 53/24; 53/59 W; 53/124 D

[58] Field of Search ..... 53/24, 124 D, 59 W

[56] References Cited

U.S. PATENT DOCUMENTS

| | | | |
|---|---|---|---|
| 2,780,987 | 2/1957 | Wall | 53/124 D X |
| 2,869,296 | 1/1959 | Overman | 53/124 D X |
| 3,086,564 | 4/1963 | Staff | 53/124 D X |
| 3,501,890 | 3/1970 | Hunt | 53/124 D |
| 3,613,559 | 10/1971 | Buisson | 53/124 D X |

*Primary Examiner*—Travis S. McGehee
*Attorney, Agent, or Firm*—Toren, McGeady and Stanger

[57] ABSTRACT

In the disclosed method, garbage is first compacted into blocks which are then inserted into a container having a closable opening and a filling space of predetermined length and also having a predetermined permissible load capacity. Pursuant to the invention, weighed quantities of garbage are compacted into blocks of substantially the same density, whereby the length of the individual blocks is dependent on the nature of the garbage. The compacted blocks of substantially the same densities are inserted into the container until the insertion of an additional compacted block would exceed the permissible load capacity and/or the filling length of the container. In this manner, maximum use of the container space and its load capacity are made without overloading the container or creating hazards during the container's subsequent transportation to a disposal area. The container is closed after the last block has been inserted. The inventive method may be electronically controlled, for example, by computer.

7 Claims, 2 Drawing Figures

26
22
3
2
14
7
1
10
II
II
4
6
17
18
25
5
19
23
21
24
20

METHOD FOR FILLING CONTAINERS WITH COMPRESSED BLOCKS OF GARBAGE

BACKGROUND INFORMATION AND PRIOR ART

As is well known, the removal of garbage or trash (hereinafter garbage) from densely populated locations presents considerable difficulties due to the large amount of garbage normally accumulating in such areas. Attempts have been made to remedy this difficulty by compressing or compacting the garbage into blocks prior to transporting the garbage to the garbage disposal areas or garbage burning plants which frequently are situated at considerable distances from the garbage collecting areas. These compressed or compacted blocks are inserted into large-size containers which are then being transported to the garbage disposal areas or plants. It will be appreciated that due to the densified or compressed form of the garbage material, the transportation is considerably facilitated in this form.

However, even garbage transportation in the manner described above causes considerable difficulties. These difficulties primarily are based on the fact that garbage is a non-homogeneous material which varies widely in respect of its density and capability of being compressed or compacted. Thus, one batch of garbabe may have a composition or nature entirely different from that of another batch and, as stated, the compressibility of the various batches may vary within large limit values. This fact makes it extremely difficult to satisfy the requirements for producing the compressed blocks and their further transportation in containers. On the one hand, it will be appreciated, the containers proper should, of course, be relatively light and inexpensive and thus are not capable of withstanding significant stresses and abuse during transport. On the other hand, container volume and the load weight which the container is capable of carrying without being damaged, should be utilized to the fullest extent. Another factor which has to be considered is that, for reason of traffic safety, the axles of the vehicles on which the containers are transported should be subjected to substantially uniformly distributed loads.

A container would satisfy these requirements which is filled as completely as possible or which is filled symmetrically with garbage blocks all of which have substantially the same density and wherein the total weight of the blocks does not exceed the permissible load capacity of the respective container.

Known devices and arrangements for the production of blocks from compressed or compacted garbage do not satisfy the above-mentioned requirements or at least satisfy such requirements in an imperfect manner only. Such known arrangements and devices are disclosed in German Offenlegungsschrift No. 2,160,460 and in the German Gebrauchsmuster No. 6,806,488. Essentially they consist of a horizontally extending press box into which opens up a filling shaft or hopper from the top, transverse to the direction of compression. A press ram is movably arranged in this press box. The material which is filled through the hopper or shaft into the box and after having passed the shaft opening is compressed or compacted by the press ram. The compression or densification is accomplished by the ram at always the same press force against a closure plate which is transversely movable. In this manner, compressed blanks or blocks are produced which, after opening of the closure plate, are pushed by the press ram into a container arranged beyond the press box. The operation is continued until the compressed or densified blocks which are inserted into the container, offer the press ram a predetermined press resistance.

The main disadvantage of such known arrangements resides in the fact that the compressed or compacted blocks which are pushed into the container one above the other, may have greatly different densities so that the basic requirement as set forth above and compliance with which is critical, is not satisfied.

SUMMARY OF INVENTION

The method according to the invention also makes use of an arrangement having the above-mentioned features, to wit, a press box with press ram, a filling opening which opens up transversely to the press direction and a closure plate for taking up the pressure during the formation of the individual blocks. However, due to the method steps described in detail hereinbelow, those defects and disadvantages are eliminated which, as stated above, occur during operation with the prior art devices.

The invention therefore has for its primary object to provide a method by means of which it is rendered possible to maintain the density of the material in the container substantially constant or with at least approximating constancy, independent from the varying nature of the garbage while, at the same time, the container is loaded with a total weight which approaches the upper permissible load limit or capacity.

This object of the invention is solved in accordance with the invention as follows:

First, the weight of each filling designated for one block is measured;

Then, during each press operation, the ram is moved forward in the press box to such an extent only that the compressed or densified block is imparted with that length which yields the desired density;

Thereafter, the established weights on the one hand and the lengths of the blocks which, due to the different composition or condition of the material are quite different, on the other hand are measured and added up, and the blocks are inserted into the container, and the filling of the container with the blocks is interrupted if the total weight of all the blocks and/or the total lengths of the sequentially inserted blocks would be exceeded by insertion of an additional block. In other words, the filling is stopped if the insertion of a further block would exceed the permissible load capacity or the total filling length of the container. By proceeding in this manner, the containers, neither during the filling nor during the further transportation, will be stressed or subjected to excess loads in an impermissible manner. On the other hand, the usable space or volume of the container is utilized to the greatest possible extent while the external load on the vehicle which carries the container is maintained within the permissible boundaries of traffic safety.

An additional advantage which flows from the inventive procedure is that while the permissible container load capacity is substantially utilized upon completion of the filling procedure, there will ordinarily still remain a space within the container adjacent the filling opening. This space, of course, insures that automatic, trouble-free closing of the container door or cover can be effected. Further, if this free space is larger than required for effecting trouble-free closing of the container, the possibility is thus offered to push in a so-called residual block into the container. For this purpose, the weight of the residual block can be determined from the difference between the permissible load capacity and the sum of the already inserted block weights. Independent from the above and considering the sum total of the block lengths inserted into the container, one can determine whether the length of the residual block — while considering the free space necessary for a trouble-free closing of the container — still permits insertion of the residual block. Should this control calculation show that the actual residual block length exceeds the desired dimension in the exceptional case, then the filling procedure is terminated and the residual block is then considered in the filling procedure for the next container.

An arrangement for carrying out the above-explained method makes use, as already stated, of the means which are disclosed in German Offenlegungsschrift No. 2,160,460 and German Gebrauchsmuster No. 6,806,488. In order to be suitable for carrying out the invention, it is, however, in accordance with the invention, necessary to associate the filling shaft with a weighing box which has an exit opening closable at the lower end, the weighing box to be arranged ahead of the shaft. Moreover, a device for measuring the path of the ram has to be provided. It also has to be assured that the ram is movable to such an extent into the container that at the end of the filling procedure, the free space necessary for closing the container will be left. Otherwise, cross-sectional size and form correspond essentially to those of the press box. The arrangement may cooperate with electronic data processing equipment, such as, a computer which is supplied with and furnishes signals, to wit, the required information. The details of such electronic data processing have not been shown and explained in view of the highly developed state of computer technology. Thus, the average computer expert could set up the necessary programming without any difficulty whatsoever and without further instructions.

The various features of novelty which characterize the invention are pointed out with particularity in the claims annexed to and forming a part of this specification. For a better understanding of the invention, its operating advantages and specific object attained by its use, reference should be had to the accompanying drawings and descriptive matter in which there is illustrated and described a preferred embodiment of the invention.

The drawings, in diagrammatical form, represent an embodiment for a garbage press for carrying out the inventive procedure.

Figure 1:
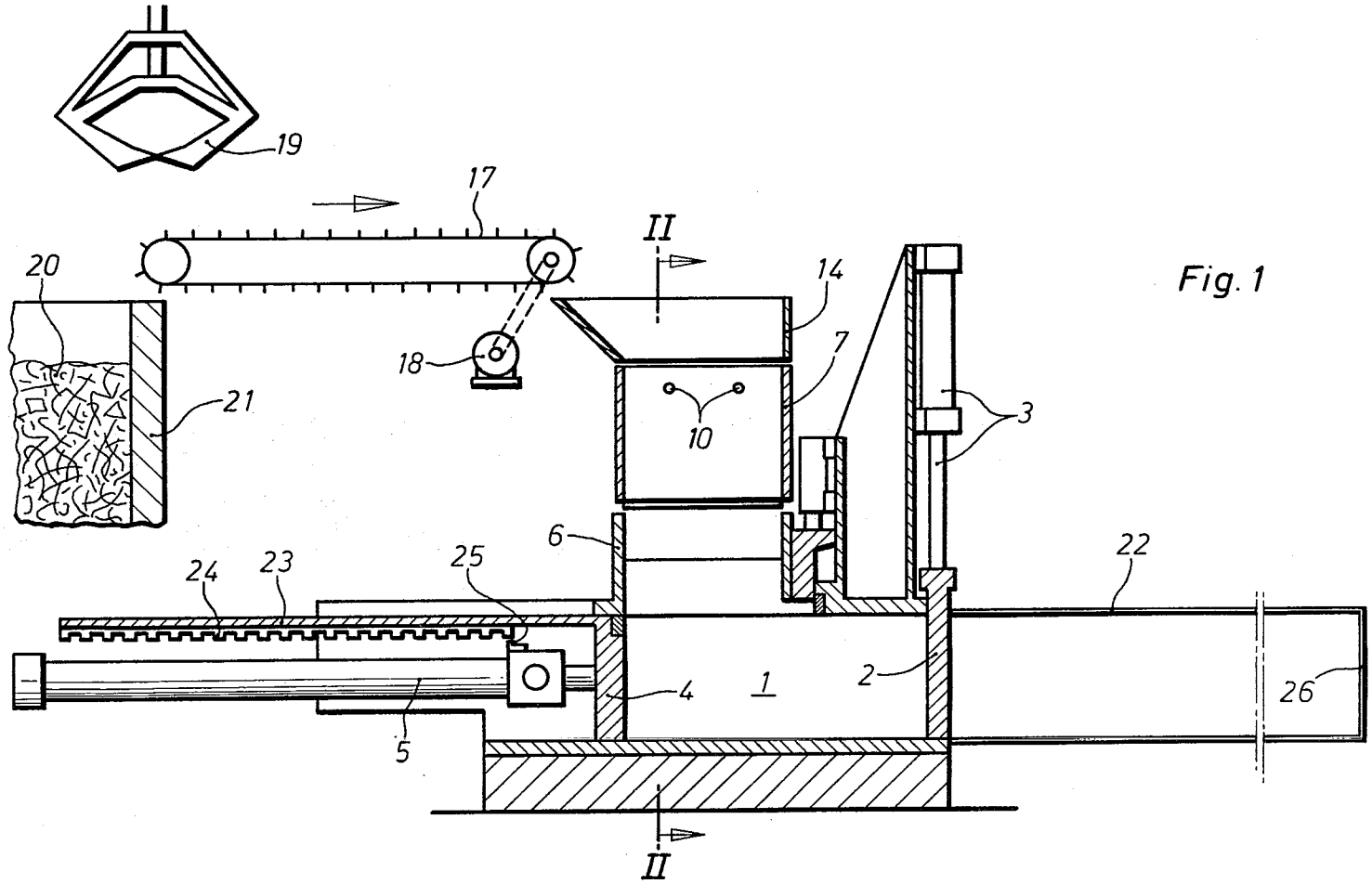
FIG. 1 is a longitudinal section through the press.
Figure 2:
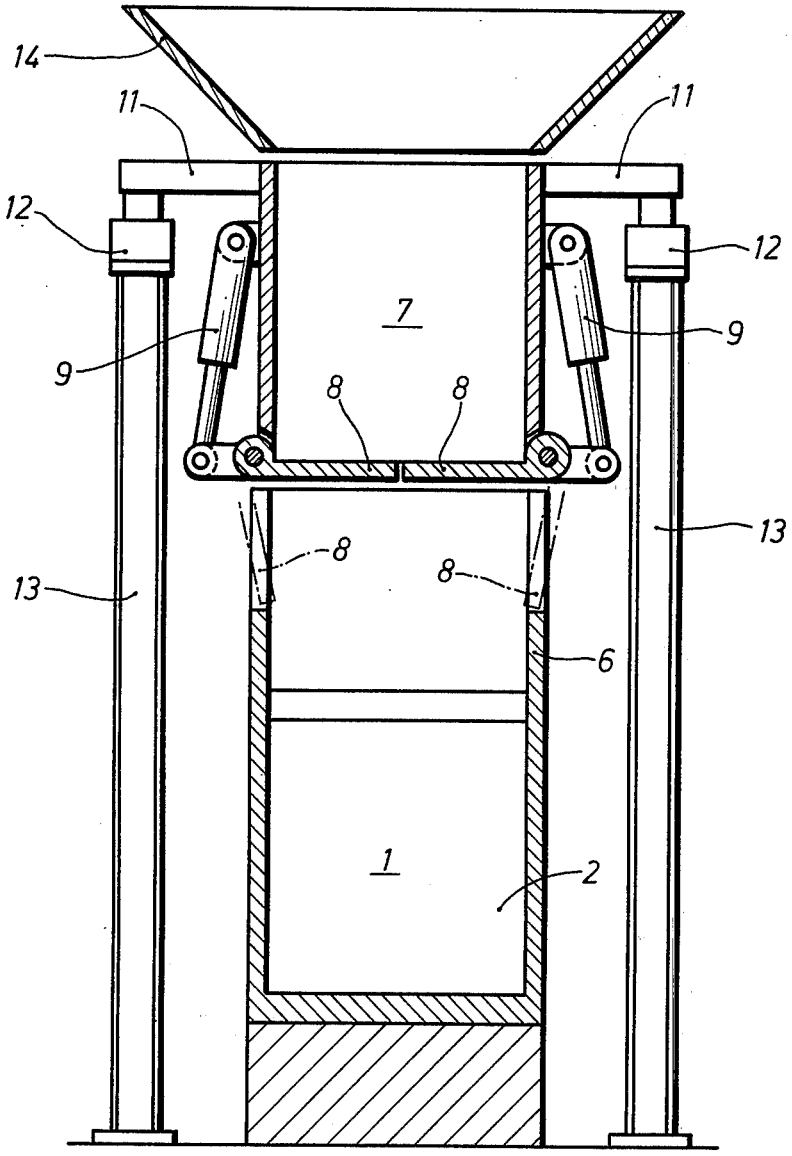
FIG. 2 is a section along line II—II in FIG. 1 on somewhat enlarged scale.

The press, according to the drawing, comprises a horizontal press box 1 which at one end, seen in FIG. 1 to the right, is closable by a vertically movable plate 2. The plate 2 may be moved up and down by means of a hydraulic cylinder piston drive 3. The plate is shown in FIG. 2 in the lower position in which the plate closes the press box 1. A ram 4 is movably arranged in the press box 1. The movement of the ram is effected by a further hydraulic cylinder piston drive 5. In the manner described below, the ram operates both as a conveying ram and also as a ram. A filling shaft 6 opens up into the press box 1 from above. The material to be densified or compacted is inserted through the filling shaft 6. Above the shaft 6, a weighing box 7 is arranged which, at its underside, is closable by flaps 8 (FIG. 2). Hydraulic drives 9 are provided for the purpose of opening and closing the flaps. Near the upper edge of the weighing box 7, light or the like wave-barriers 10 are provided which determine the upper limits of the box filling. In other words, they interrupt the supply of material as soon as the level of the material has reached the barriers 10. The weighing box 7 is vertically movably mounted on pressure measuring boxes 12, the mounting being effected by means of arms 11. The pressure measuring boxes 12, in turn, are supported relative to the foundation through supports 13. The weighing box 7 serves the purpose to determine the weight of the amount of material which in each case is provided or required for the formation of one block.

Above the weighing box 7, there is provided a stationary filling funnel 14 by means of which trash or garbage can be inserted into the weighing box 7. Weighing box and filling funnel 14 may be made of a single piece. For filling purposes, a conveyor belt 17 is provided which is actuated by a drive motor 18. Trash or garbage is supplied to the belt 17 by means of a gripper 19 which takes the material 20 from a supply stored in the bunker 21. The garbage material which reaches the box 1 through the shaft 6 is pushed by the ram 4 against the plate 2 which is then in the position shown in FIG. 1. As soon as the ram 4 moves past the lower mouth of the shaft 6, the material, in cooperation with the plate 2, is compacted to form a block. A container 22 for receiving the compacted blocks may be connected at the mouth or end of the box 1 which is closed by the plate 2. The connection of the container 22 can be accomplished by mechanical means (not shown). When the plate 2 has been moved into the upward position, the box 1 and the container 22 form a connected hollow space, since the cross-section of the container 22 in respect of size and dimensions corresponds essentially to that of the box 1. The container 22 is closable at its filling end by means of doors or covers (not shown).

For reasons explained in the introduction of this application, it is essential for the invention that the path of the ram 4 is measured. For this purpose a gearing 24 is arranged at a cover plate 23 which is rigidly connected with the ram 4. The gearing 24 cooperates with a stationary inductive tap 25 at which the teeth of the gearing 24 move past during the forward and rearward strokes of the ram 4 and thus cause pulses whose number corresponds to the respective path or stroke of the ram 4 and which are supplied to the computer (not shown).

The press which has been described so far may be associated, a mentioned, with a computer which is supplied with and furnishes signals corresponding to the information. Supplied are the signals which are generated from the pressure measuring boxes 12 which signals correspond to the respective garbage weight in the filling box 7 and also those signals which are delivered by the inductive tap 25. These signals correspond to the path or stroke which has been travelled by the ram 4. The signals which are furnished by the computer control the pressure stroke of the ram 4 and the drive 18 of the belt 17.

FIG. 1 shows the situation at the start of the operation. The press box 1 is closed by the plate 2 and the ram 4 is moved back or retracted towards the left. The flaps 8 of the weighing box 7 are situated in the closure position shown in FIG. 2.

At the start of the operation, the conveyor belt 17 is charged with material by means of the gripper 19 and the motor 18 is started up so that material will fall into the weighing box 7. At the latest when the level of the material in the weighing box 7 has reached the barriers 10, the motor 18 is shut off and the material supply is thus interrupted. The filled in material is weighed and the measured value is stored in the computer. Subsequently, the flaps 8 are opened so that the material amount which has collected in the weighing box 7 falls into the press box 1 whereupon the flaps 8 again can be closed and a fresh filling of the weighing box 7 can start, the motor 18 again being started up. At the same time, the ram 4 is moved forward towards the right corresponding to the indicated path, the ram moving the inserted material against the plate 2 in order to compress a first garbage block.

The compression pressure in each case is such that the pressure, independent from the composition or nature of the material imparts all compressed blanks or blocks the same density or specific weight.

Due to different weights per weighing box filling, each press operation, of course, results in the formation of blocks of different length (calculated in the direction of compression). When the press operation has terminated, the ram 4 is at rest, the length of the block is measured through 24, 25 the plate 2 is moved upwardly and the ram 4 — now solely acting as a conveying ram — is moved towards the right into the container 22 until the block is removed so far from the plate 2 that the plate 2 again can be closed without obstruction. Thereupon, the ram 4 moves back into its rearward position whereby at the same time the plate 2 moves downwardly. The above-described operating cycle in respect of filling of material etc. is then repeated in order to compress a second garbage block and to push it into the container 22. Weight and length of the second block and correspondingly all subsequent blocks are added to the values stored in the computer. The pushing-in stroke of the ram 4 into the container 22 is limited by an end switch (not shown) which, in turn, switches the ram drive 5 for return movement. When each further block is pushed in, the row of blocks which have already been inserted into the container is moved further frontwards within the container 22. The operating steps or cycles are repeated until the established load capacity of the container has been reached.

The blocks which thus are produced with substantially the same density differ, of course, necessarily in respect of their length. Due to the measurements of the ram path — which is accomplished by the gearing 24 and the tap 25 — and the addition of the individual block lengths and weights in the computer as described hereinabove, the operator knowns when the container 22 is filled to such an extent that it is not capable of taking up a further complete block. If the length of the residual block is determined by means of the computer, then, if the weighing box 7 is empty, the motor 18 is again started up, to wit, for such a period until the computer, via the pressure measuring boxes 12 is notified of a weight which corresponds to that of the residual block. The flaps 8 of the weighing box 7 are then opened and the material contained in the weighing box is emptied into the press box 1 so that the ram 4 can compress the residual block and can push it subsequently into the container 22.

Instead of closing the container at the right hand end by a rigid plate, which would mean that the container 22 has to be emptied by tilting, it is possible to close the right hand end 26 by means of a plate which is movable along the container. This plate is first situated near the left hand end and in the course of the proceeding is stepwise moved towards the right by the inserted blocks. The respective position of such a plate is a measure of the respective filling extent of the container. This position can also be evaluated by the computer. In this manner, in addition to the actually produced block lengths, also material expansions can be considered by the computer in the block length addition.

While a specific embodiment of the invention has been shown and described in detail to illustrate the application of the inventive principles, it will be understood that the invention may be embodied otherwise without departing from such principles.

What is claimed is:

1. A method of compacting heterogeneous garbage into blocks and inserting a plurality of the compacted blocks into a container having a closable opening and having a filling space of predetermined length and a predetermined permissible load capacity, said method comprising:

a. feeding a first quantity of garbage into a box;

b. weighing the first quantity of garbage feed into the box;

c. discharging the first quantity of garbage from the box into a compacting chamber;

d. compacting said first quantity of garbage in said compacting chamber based on the weight of the garbage into a first block of predetermined density, whereby the length of said first block is dependent on the weight characteristic of the garbage making up the block;

e. determining the length of said first block based on the length required to establish the predetermined density;

f. inserting said first block through said opening into the container;

g. repeating steps a) through e) with further quantities of heterogeneous garbage to form additional blocks of the same said predetermined density as said first block which further blocks are inserted into said container;

h. discontinuing the insertion of further compacted blocks into said container when the total length of all inserted blocks is sufficient for substantially filling the predetermined length of said container so that the closable opening can be inserted into the container without interference.

2. A method as claimed in claim 1 wherein closing said closable opening of the container after the last block has been inserted which completes the predetermined length of the container.

3. A method as claimed in claim 2 wherein, prior to said closing of said opening, and provided the total length of all inserted blocks is less than the load capacity based on the predetermined length of said container, adding a weight of garbage into the chamber sufficient to form an additional residual block, compacting the garbage and inserting the compacted block into said container so that the length of the inserted block is substantially equal to said predetermined length of the filling space and does not exceeded the predetermined length.

4. A method as claimed in claim 1 wherein electrically storing and accumulating the weight measurement and length determination values of steps a) and d) discontinuing the compaction and insertion of garbage into the container when the electronic indication signals that the insertion of a further compacted block of step g) would exceed said predetermined length of the filling space of the container.

5. A method as claimed in claim 1 wherein compacting the garbage in said compacting chamber is effected by a ram, controlling the compacting stroke of said ram in dependence on the weight of garbage discharged into said chamber to effect compaction of the block to said predetermined density.

6. A method as claimed in claim 1 wherein the cross-section of said compacting chamber is substantially the same as the cross-section of said container thereby to facilitate insertion of said block from said compacting chamber into said container.

7. A method as claimed in claim 5 wherein said container and said compacting chamber are arranged in juxtaposed position with the opening of said container in alignment with the discharge opening of said compacting chamber, and said ram, after compacting said block, pushing said block through said opening into said container.

* * * * *